United States Patent [19]

Soga et al.

[11] Patent Number: 4,917,637

[45] Date of Patent: Apr. 17, 1990

[54] WATERJET PROPULSION SYSTEM FOR WATERCRAFT

[75] Inventors: Katsumasa Soga; Jiro Kitao, both of Kobe, Japan

[73] Assignee: Kawasaki Jukogyo Kabushiki Kaisha, Japan

[21] Appl. No.: 198,752

[22] Filed: May 25, 1988

[30] Foreign Application Priority Data

May 28, 1987 [JP] Japan ..... 62-81503

[51] Int. Cl.[4] ..... B63H 11/113

[52] U.S. Cl. ..... 440/42; 60/221; 440/43

[58] Field of Search ..... 114/166; 440/42, 43, 440/41, 40, 67, 68; 60/221

[56] References Cited

U.S. PATENT DOCUMENTS 2,369,279 2/1945 Carnaghan et al. ..... 114/166
3,481,303 12/1969 Tate et al. ..... 440/42 X

FOREIGN PATENT DOCUMENTS 2300821 7/1974 Fed. Rep. of Germany ..... 440/42
51-6871 2/1976 Japan .
75898 4/1984 Japan ..... 114/166

*Primary Examiner*—Sherman D. Basinger

[57] ABSTRACT

A waterjet propulsion system for a watercraft including a duct disposed on the bottom of the watercraft with the opening facing backward, a device to produce waterjet in the duct and a steerable nozzle fitted on the duct opening. Inside the nozzle, a flow guide extending forwardly beyond a supporting axis for the nozzle is formed integrally with the nozzle. For the flow guide, a plate or plates fitted vertically respectively including or parallel to the nozzle centerline or a cylinder mounted coaxially with the nozzle can be preferably employed.

4 Claims, 3 Drawing Sheets

WATERJET PROPULSION SYSTEM FOR WATERCRAFT

FIELD OF THE INVENTION AND RELATED ART STATEMENT

This invention relates to a waterjet propulsion system adapted for a watercraft, more specifically to a nozzle for the propulsion system.

In general, in the waterjet propulsion system of a watercraft, the watercraft is propelled by the thrust produced by a high speed waterjet discharged from the nozzle at the rear end of the duct disposed at the bottom of the watercraft. The waterjet is produced by the impeller mounted in the duct.

The above nozzle mounted at the rear end of the duct rotatably around pins vertically disposed in steered to turn the watercraft by changing the direction to which the waterjet is spouted. The nozzle is steered by a steering device like a handle bar through a transmission gear.

To attain a high efficiency in spouting of a high speed waterjet, a cylindrical nozzle having a cylindrical internal surface has been employed and is now still used.

But the waterjet propulsion system according to the conventional art has drawbacks, because, when steered, the nozzle tends to turn back to its original position around the pins by a moment of forces created at a certain speed of the waterjet by a change in the direction in which the waterjet spouts. Therefore, to keep the waterjet running in a desired direction after it is changed, the watercraft operator is required to apply a great force on the steering device to maintain the nozzle at the desired position after it is steered.

Particularly, while changing the watercraft sailing direction, as the jet speed increases, the watercraft at a high speed experiences a great force on the nozzle from the water on which the watercraft is sailing, so that the operator needs to operate the steering device with a great force.

As a larger watercraft requires more powerful propulsion of the waterjet propulsion system, the tendency above mentioned is strong.

In a large watercraft, a power steering gear like a mechanical or hydraulic system is used between the steering device and the nozzle, resulting in a complicated mechanism.

OBJECT AND SUMMARY OF THE INVENTION

The object of the invention is to provide a waterjet propulsion system capable of reducing the power needed to steer the nozzle, which can eliminate the aforesaid drawbacks of the prior art.

To achieve the object above mentioned, the nozzle according to the invention has a flow guide therein which extends forward beyond the position at which the nozzle is mounted on the duct so as to be able to rotate horizontally to the right and left of the waterjet propulsion system around the pins. One or a plurality of plates fixed vertically parallel to the nozzle center line or a cylinder mounted coaxially with the nozzle are preferably employed to form the flow guide.

The invention allows the operator to exert less force in the operation of the steering device in the course of changing the direction in which the watercraft is sailing, since the imbalance of the forces acting on the nozzle is reduced by the following two forces working opposite to each other: one force acting on the front part of the flow guide located in front of the place at which the nozzle is mounted, and the other force from the flow acting on the rear part of the nozzle.

Further, in an embodiment of the invention, provision of a power steering system like a hydraulic system can be eliminated.

BRIEF DESCRIPTION OF THE DRAWINGS

In the accompanying drawings, there are shown illustrative embodiments of the invention from which these and other of its objectives, novel features and advantages will be readily apparent.

DETAILED DESCRIPTION OF PREFERRED EMBODIMENT

The following drawings depict in detail preferred embodiments in accordance with the invention.

Figure 1:
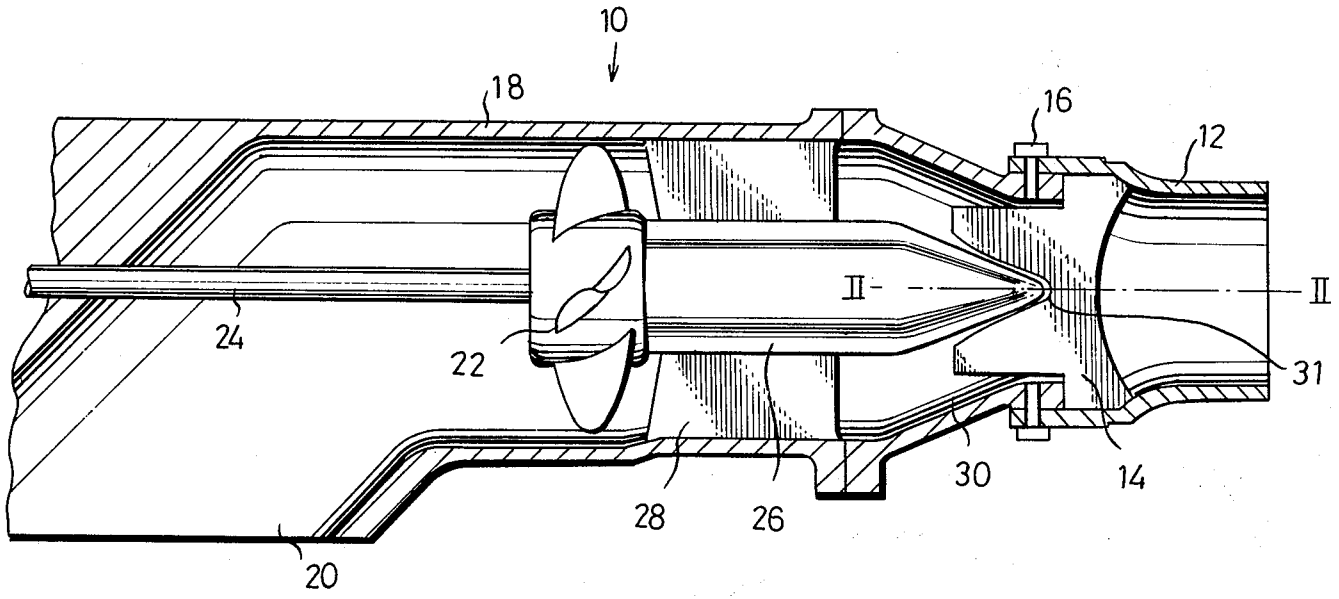
FIG. 1 is a sectional side view of the essential part of a waterjet propulsion system in an embodiment according to the invention.
Figure 2:
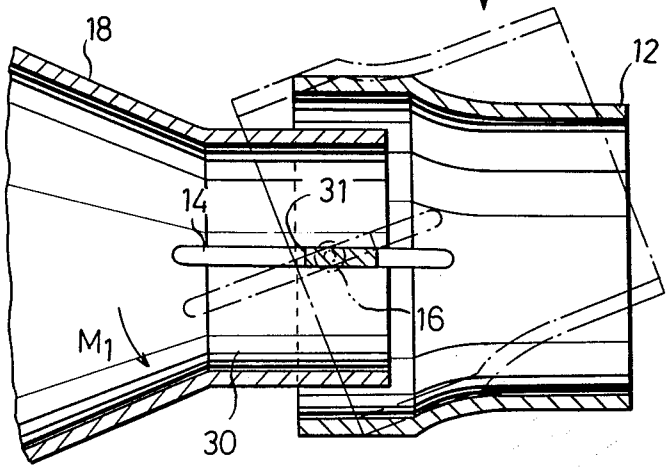
FIG. 2 is a sectional plan view taken along the line II—II in FIG. 1.

FIGS. 1 and 2 show an embodiment of the invention.

To minimize the running resistance a sailing watercraft is exposed to, the waterjet propulsion system 10 is recessed on the inner surface of the bottom shell of the watercraft.

The impeller 22 housed in the duct 18 is mounted on the shaft 24 driven by the engine (not shown). The shaft 24 is supported by the bearing fitted in the boss 26 which, in turn, is fixed on the inside surface of the duct 18 by means of a guide vane 28.

At the bottom of the fore region of the duct 18, the intake 20 is provided and the rear part of the duct 18 is gradually reduced in its sectional area to form a restriction 30. On the rear end of the restriction 30 the nozzle 12 is rotatably mounted horizontally by and around a pair of pins 16 inserted vertically, one at the top and the other at the bottom.

A piece of flat plate is fitted vertically across the inside of the nozzle 12 to form a flow guide 14. Though the flow guide 14 extends forward further beyond the location where the pins 16 are inserted in the nozzle 12, a central cut 31 in the flow guide 14 having the same profile as that of the stream-lined rear end of the boss 26 permits the flow guide 14 to extend over the rear end of the boss 26 without interference.

The nozzle 12 is connected to the steering device such as a handle bar via a transmission gear like a control cable (not shown), so that the operator can steer the nozzle 12 around the pins 16 as mentioned earlier.

In the above mentioned embodiment, the water taken in from the intake 20 by the pumping action created by the rotation of the impeller 22 driven by the engine flows along the inside of the duct 18, passes the guide vane 28 by which the water flow is stabilized and the restriction 30, and is discharged from the nozzle 12 at high speed, producing a thrust to propel the watercraft.

FIG. 2 is a sectional plan view taken along the line II—II in FIG. 1, illustrating the essential part of the nozzle 12.

FIG. 2 shows that the flow guide 14, extending forward beyond the pins 16 inserted in the nozzle 12, is formed integrally with the nozzle 12. The position of the nozzle 12 when rotated to the right is indicated by a dash and dot line.

As shown in FIG. 2, when the nozzle 12 takes a position in line with the center line of the restriction 30, the water flow from the restriction 30 runs straight in the nozzle 12 to jet out the high speed jet directly in the backward direction. In this case the water flow runs straight without a couple of hydrodynamic forces, which may cause a moment around the pins 16, acting on the flow guide 14 and the nozzle portion at the back of the pins 16.

As the dash and dot lines show, when a rotation of the nozzle 12 places the centerline of the nozzle 12 at a slant to that of the restriction 30. the water flow from the restriction 30 is discharged out of the nozzle 12 after the direction of the flow is changed in the nozzle 12. In this case, the waterflow produces a moment M1 around the pins 16 acting on the flow guide 14 and another moment M2 around the pins 16 acting on the nozzle part 12 located at the back of the pins. These moments tend to offset each other, reducing the resulting inbalance of the moments around the pins 16, thus resulting in that the steering force and the gripping force of the operator to be applied on the steering device can be lowered. Moreover, the auxiliary power transmission device such as mechanical or hydraulic can be eliminated, thus leading to a light weight and lower cost watercraft.

Figure 3B:
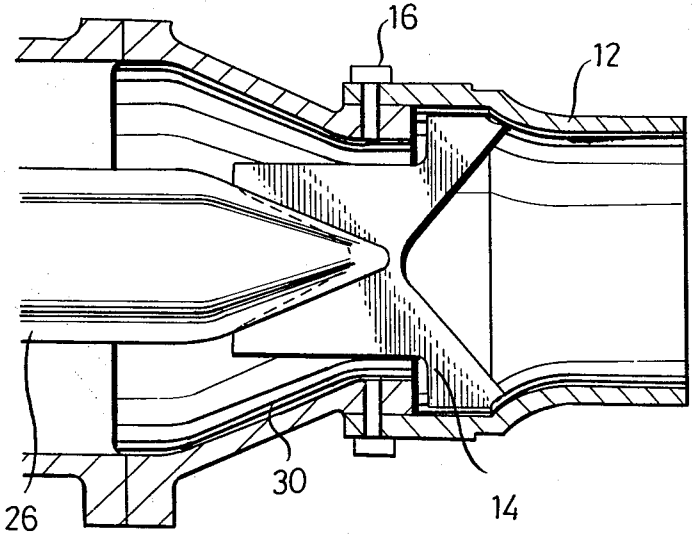
FIGS. 3A and 3B are a sectional view and a sectional side view of the nozzle and the surrounding area of another embodiment according to the invention.
Figure 3A:
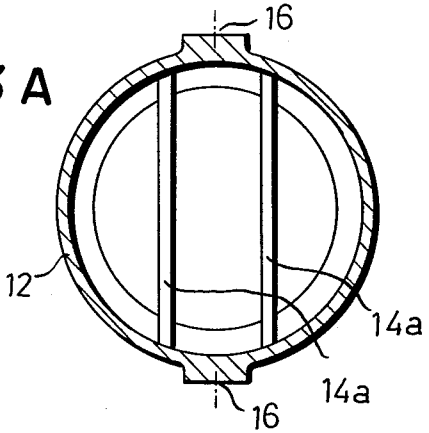

FIGS. 3A and 3B show another embodiment according to the invention, illustrating a way in which the flow guides are fitted in a nozzle.

In this embodiment, two vertical flat plates disposed in parallel compose flow guides **14*a* in the nozzle 12. Uniformity of the waterflow can be improved by dividing the cross-sectional area of the nozzle 12 with the aforesaid flow guides 14*a*, so that the amount of imbalance of the forces is further reduced because the force of the flow acting on the flow guides 14*a*** becomes greater.

Figure 4B:
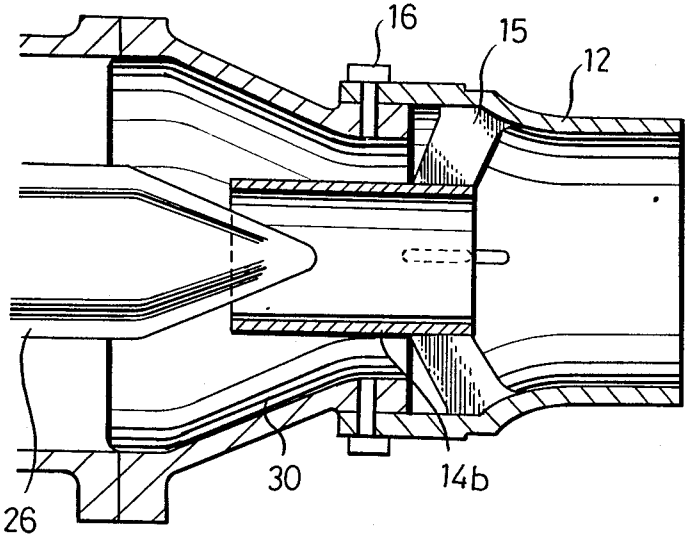
FIGS. 4A and 4B are a sectional view and a sectional side view of a further embodiment according to the invention.
Figure 4A:
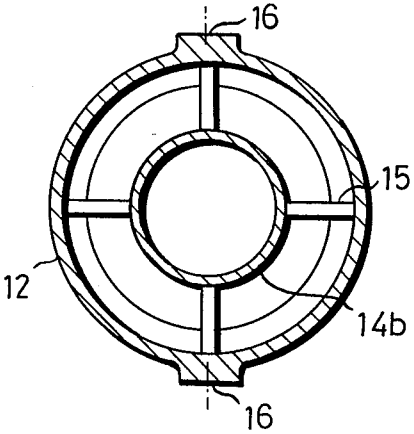

FIGS. 4A and 4B show a further embodiment according to the invention, illustrating a cylindrical flow guide **14*b* fitted in the nozzle 12 coaxially therewith. A fixture 15 connects the flow guide 14*b* to the nozzle 12. In this manner, the coaxially-divided cross-section of the nozzle 12 allows the waterflow to be distributed evenly across the cross sectional of the nozzle 12, with the result that the amount of the imbalance of the forces of the waterflow diminishes because the waterflow exerts a force on the flow guide 14*b*** even more effectively.

It is understood that the foregoing describes only some preferred embodiments of the invention and that various changes and modifications may be made to the invention without departing from the spirit and scope thereof.

What is claimed is:

1. A waterjet propulsion system for a watercraft comprising a duct disposed on the bottom of the watercraft and having an opening facing backward, means for producing a waterjet in said duct, a steerable nozzle supported rotatably around a vertical axis at said duct opening, a rear part of said duct being gradually reduced in its cross-sectional area to form a restriction, a fore end of said nozzle surrounding said rear part of said duct, and a flow guide mounted inside of and integrally with said nozzle and extending forward beyond said vertical axis into said restriction.

2. A waterjet propulsion system as claimed in claim 1 wherein said flow guide consists of a vertical plate including the centerline of said nozzle.

3. A waterjet propulsion system as claimed in claim 1 wherein said flow guide consists of a plurality of vertical plates parallel to the centerline of said nozzle.

4. A waterjet propulsion system as claimed in claim 1 wherein a cylindrical flow guide is fitted coaxially to said nozzle.

* * * * *